US005439436A

United States Patent [19]

Moll

[11] Patent Number: 5,439,436

[45] Date of Patent: Aug. 8, 1995

[54] BOXED POCKET FOLDING MACHINE

[76] Inventor: Richard J. Moll, 415 Constance Dr., Warminster, Pa. 18974

[21] Appl. No.: 245,439

[22] Filed: May 18, 1994

[51] Int. Cl.[6] ..... B31B 1/60

[52] U.S. Cl. ..... 493/394; 493/245; 493/246; 493/251; 493/263; 493/264; 493/399; 493/419; 493/453; 493/931; 493/947

[58] Field of Search ..... 493/186, 221, 243, 244, 493/245, 246, 248, 251, 252, 260, 263, 264, 394, 399, 405, 419, 423, 436, 441, 453, 931, 947; 229/1.5 R, 72, 87.5

[56] References Cited

U.S. PATENT DOCUMENTS

| | | | |
|---|---|---|---|
| 3,668,979 | 6/1972 | Cariven | 493/254 |
| 4,041,849 | 8/1977 | Tsukasaki | 493/436 |
| 4,989,777 | 2/1991 | Miller | 249/72 |
| 5,025,978 | 6/1991 | Paclone | 493/264 |
| 5,141,485 | 8/1992 | Welt | 229/72 |

*Primary Examiner*—Bruce M. Kisliuk
*Assistant Examiner*—Eileen P. Morgan
*Attorney, Agent, or Firm*—Z. T. Wobensmith, III

[57] ABSTRACT

A folding machine which takes a prescored blank of paper, folds side flaps up, and glue tabs down, applies a glue line to the tabs, and folds end flaps of the blank about score lines onto the glue tabs to form boxed pockets and then delivers the finished folder for use.

5 Claims, 6 Drawing Sheets

BOXED POCKET FOLDING MACHINE

BACKGROUND OF THE INVENTION

1. Field of the Invention

A folding machine of the type which produces a boxed pocket paper folder from a prescored blank, which folder has side flaps that are folded upwardly, and contiguous glue flaps folded downwardly about former bars by guideplates, glue is applied, and a pair of end flaps are folded up and down by a tipper plate, pusher plate, and fold plate onto the glue flaps forming a folder with two boxed pockets.

2. Description of the Prior Art

In the printing trade, folders are often required which have two pockets therein which can be used to hold various items. To form the pockets a sheet of paper is scored up from and parallel to the bottom to form a pair of flaps. A glue line is applied to one or more edges of the flaps, which are folded up along the score line to contact the main sheet of paper, adhere thereto along the glue line and form a pocket. This type of pocket is limited in its capacity, is not well formed and suffers from other disadvantages. A boxed pocket is more desirable, but it requires additional score lines and side flaps, which when glued and folded produces pockets that are square and hold a greater amount of items.

Various apparatus have been proposed to provide boxed pockets by folding cover flaps up and then over onto a main sheet, but the previously available apparatus was very slow in operation, and while the operation is often performed by hand, this results in high cost.

Since the finished folders have boxed pockets which are raised from the main panels and are somewhat fragile, depending on the paper stock, it is necessary to have a folding machine that quickly and easily properly forms the pockets and then transports the finished folders without damage.

The folding machine of the invention produces boxed pocket folders that are properly formed, do not suffer from the shortcomings of the prior apparatus, and provide many positive advantages.

SUMMARY OF THE INVENTION

This invention relates to a boxed pocket paper folding machine which receives a die cut paper blank which has been prescored, folds up side flaps, folds over glue tabs, applies glue onto the tabs and then folds the end flaps up and then down to meet the glue tabs and form boxed pockets.

The principal object of the invention is to provide a boxed pocket paper folding machine, which takes a prescored paper blank, folds up side flaps and glue tabs, applies glue thereto and then folds end flaps onto the tabs to form a finished folder.

A further object of the invention is to provide a folding machine of the character aforesaid, which is fast and accurate in its operation, and provides a high quality finished product.

A further object of the invention is to provide a folding machine of the character aforesaid, which can operate with a variety of types of paper stock.

A further object of the invention is to provide a folding machine of the character aforesaid, which can operate with a variety of feeder apparatus.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structure disclosed without departing from the spirit of the invention.

Like numerals refer to like parts throughout the several views.

DESCRIPTION OF THE PREFERRED EMBODIMENT

Figure 1:
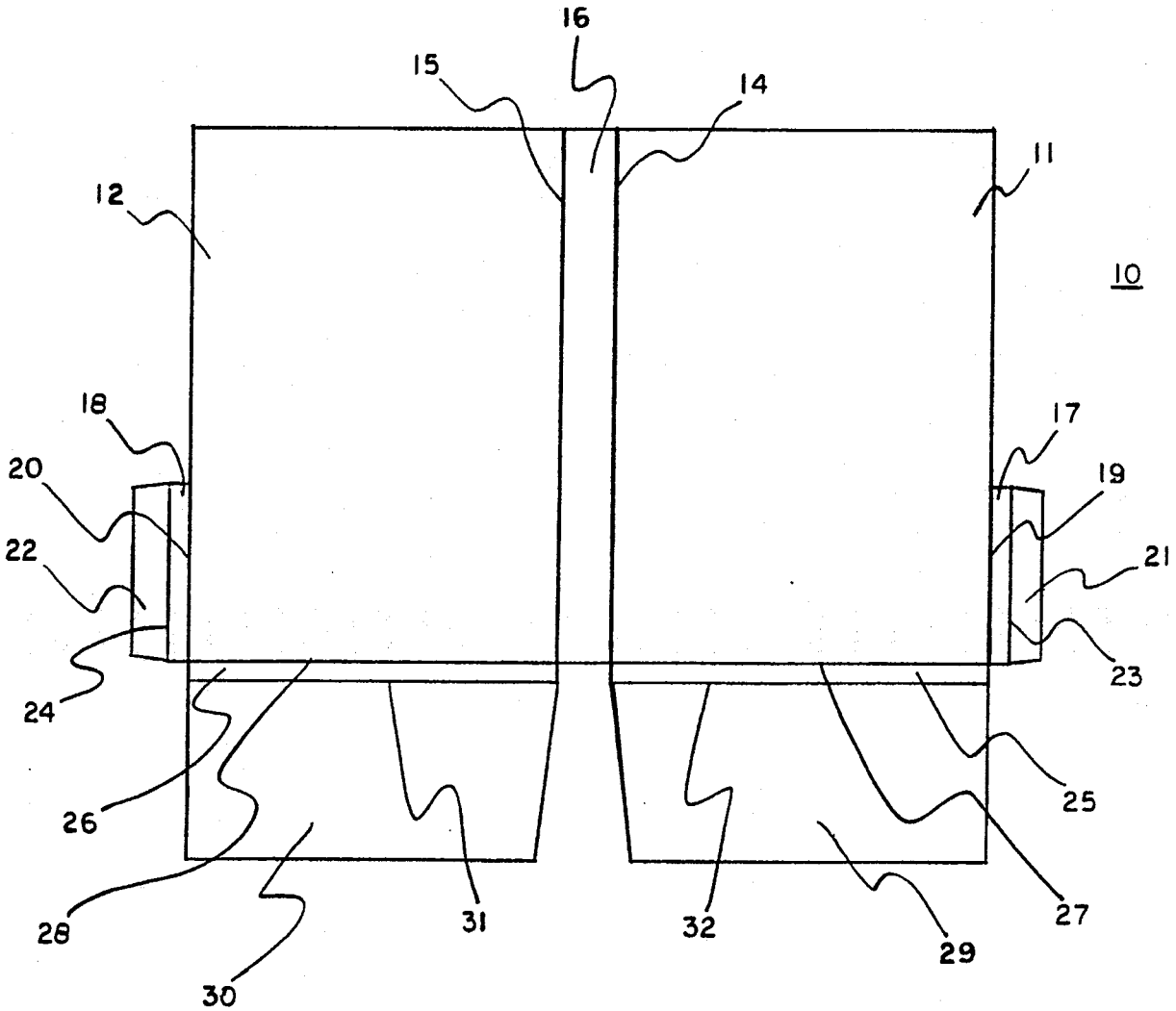
FIG. 1 is a plan view of a prescored paper blank used with the folding machine of the invention.
Figure 2:
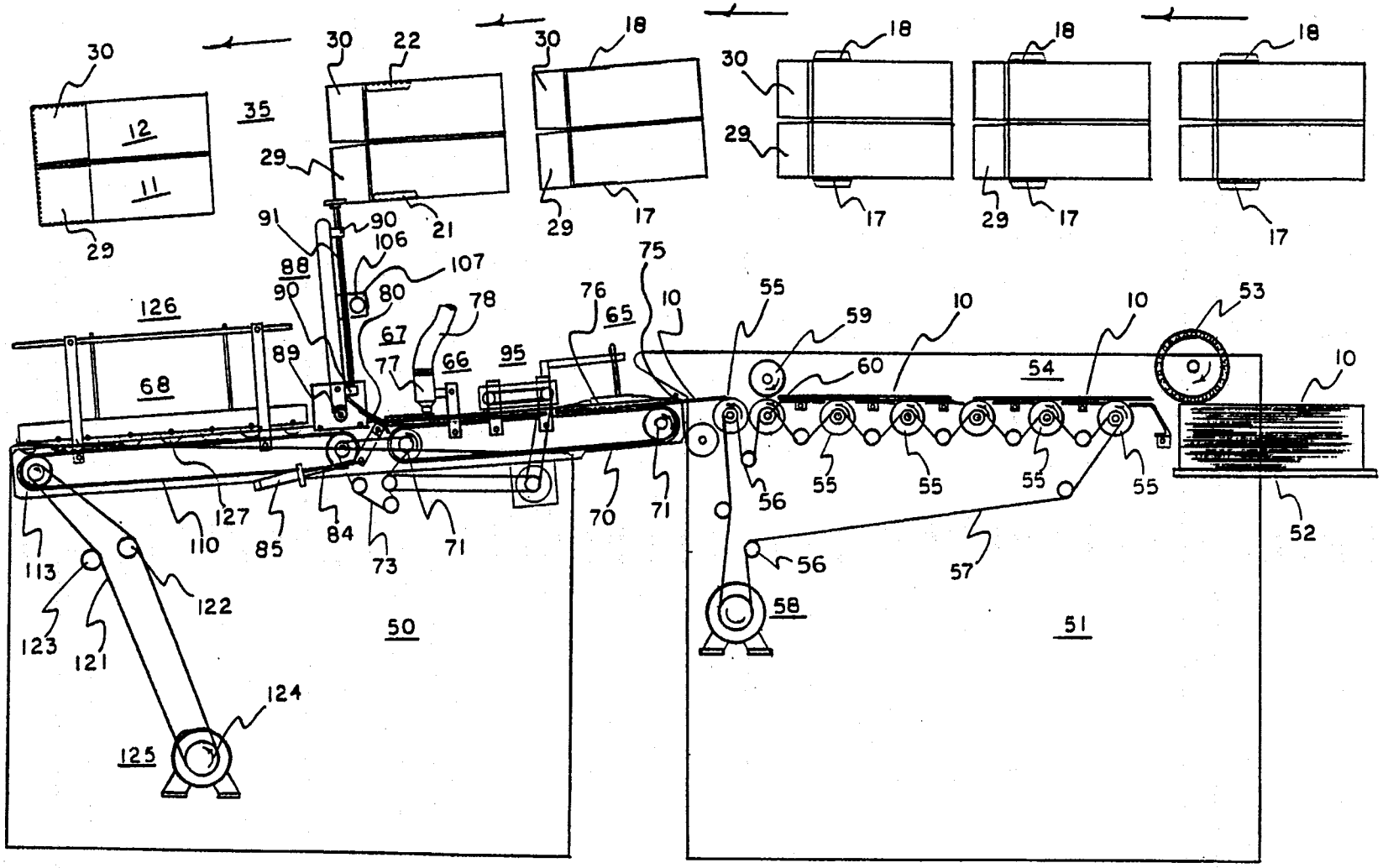
FIG. 2 is a side elevational diagrammatic view of the folding machine of the invention.

Referring now more particularly to the drawings and FIG. 1, thereof a paper blank 10 to be formed by the folding machine to be described is therein illustrated. The blank 10 is of generally rectangular shape and has preferably been formed by die cutting (not shown). The blank 10 includes main panels 11 and 12 which are joined along score lines 14 and 15 to a center panel 16.

The main panels 11 and 12 have side panels 17 and 18 joined thereto along score lines 19 and 20. The side panels 17 and 18 have glue tabs 21 and 22 joined thereto along score lines 23 and 24. The main panels 11 and 12 have intermediate panels 25 and 26 joined thereto along score lines 27 and 28. The intermediate panels 25 and 26 have end flaps 29 and 30 joined thereto along score lines 31 and 32.

It is preferred that score lines 19, 20, 23, 24, 27, 28, 31 and 32 are formed on both sides of the blank 10.

Referring now additionally to FIGS. 2–6 the folding machine 50 which transforms a blank 10 into a finished product 35 is therein illustrated. A blank feeder apparatus 51 is shown to the right of folding machine 50 which can be of any well known desired type.

The feeder apparatus 51 includes a vertically movable feeder table 52 which has a stack of blanks 10 thereon, which are picked off one at a time by an air wheel 53 and deposited onto a conveyor section 54.

The conveyor section 54 includes a plurality of rollers 55 and 56 driven by a belt 57 which is connected to a drive motor 58. The blanks 10 are transported by rollers 55 to and between exit rollers 59 and 60 from which they are delivered to the folding machine 50.

The folding machine 50 comprises four sections, i.e. a first stage folding section 65, a gluing section 66, a second stage pocket forming section 67, and a delivery section 68.

The first stage folding section 65 has a conveyor belt 70 which receives the blanks 10 from the feeder apparatus 51. The conveyor belt 70 is connected to two rollers 71 which are driven by a belt 73. As shown sequentially in FIG. 4 and proceeding from top to bottom, as the blanks 10 move along in the first stage folding section the side panels 17 and 18 are bent up along score lines 19 and 20 over former bars 75 by outer guide plates 76. Glue tabs 21 and 22 are then bent down upwardly about score lines 23 and 24 until the tabs 21 and 22 are parallel to panels 11 and 12. The tabs 21 and 22 are now in gluing section 66 and pass under glue dispensing heads 77 of conventional well known type such as described in my prior patent U.S. Pat. No. 4,865,578. The glue heads 77 are connected to a source of hot glue (not shown) by hose 78, and dispense a measured amount of hot glue onto tabs 21 and 22 as required.

The blanks 10 are now in the second stage or pocket forming section 67.

A tipper plate 80 is provided which receives the blanks 10 from gluing section 66. The tipper plate 80 is connected to a pair of arms 81 by pin 82, which is pivotedly engaged with the frame (not shown) of folding machine 50 to permit plate 80 to move from a horizontal position to an angled position to guide the blanks 10, to be described. The arms 81 are connected by a second pin 83 which is engaged by rod 84 from a push-pull cylinder 85 which causes rotation of the arms 81 about pin 82 and consequent pivoting of tipper plate 80.

A vertically oriented fold plate 88 is provided adjacent plate 80 which includes a bottom mounted roller 89. The plate 88 is mounted to brackets 90 which are carried on machine 50, and plate 88 is vertically adjustable in well known manner by rotation of rod 91 which is engaged therewith and with brackets 90.

Figure 3:
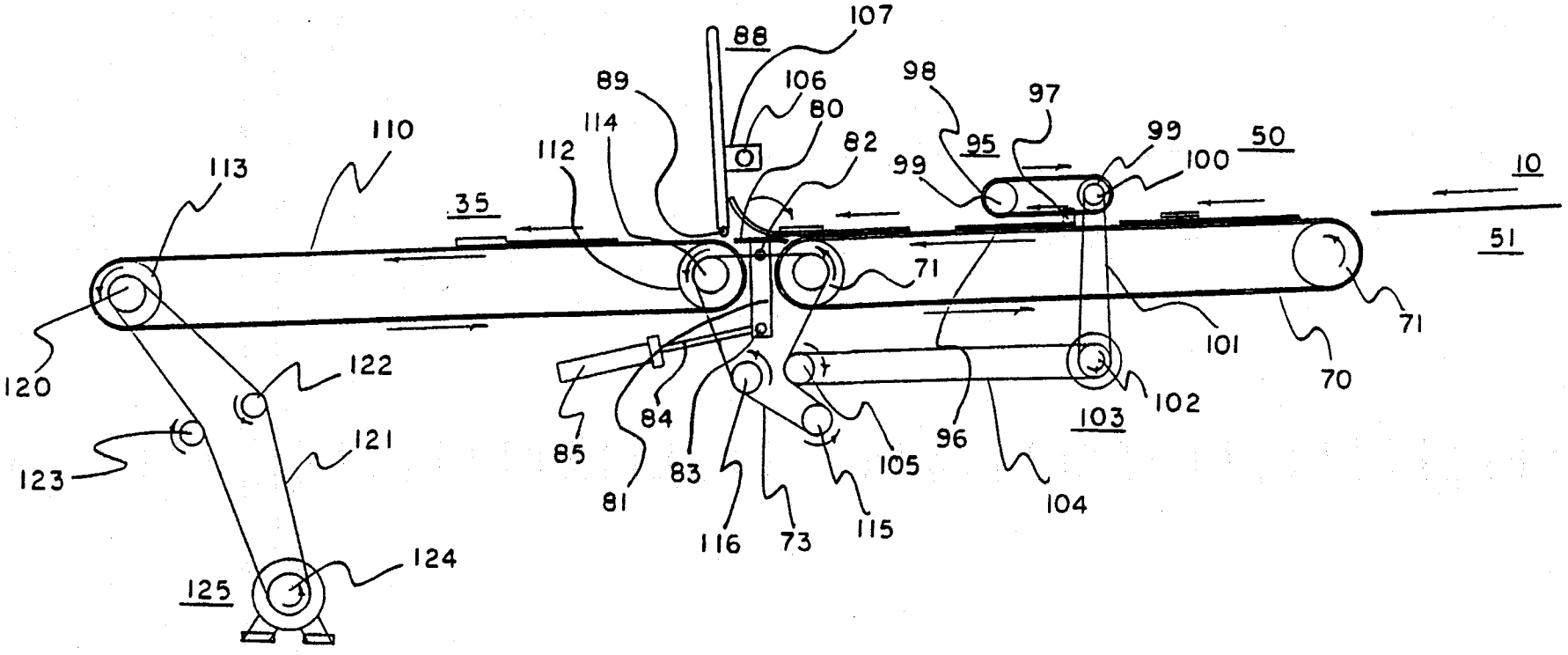
FIG. 3 a diagrammatic view of the folding machine of FIG. 2.
Figure 4:
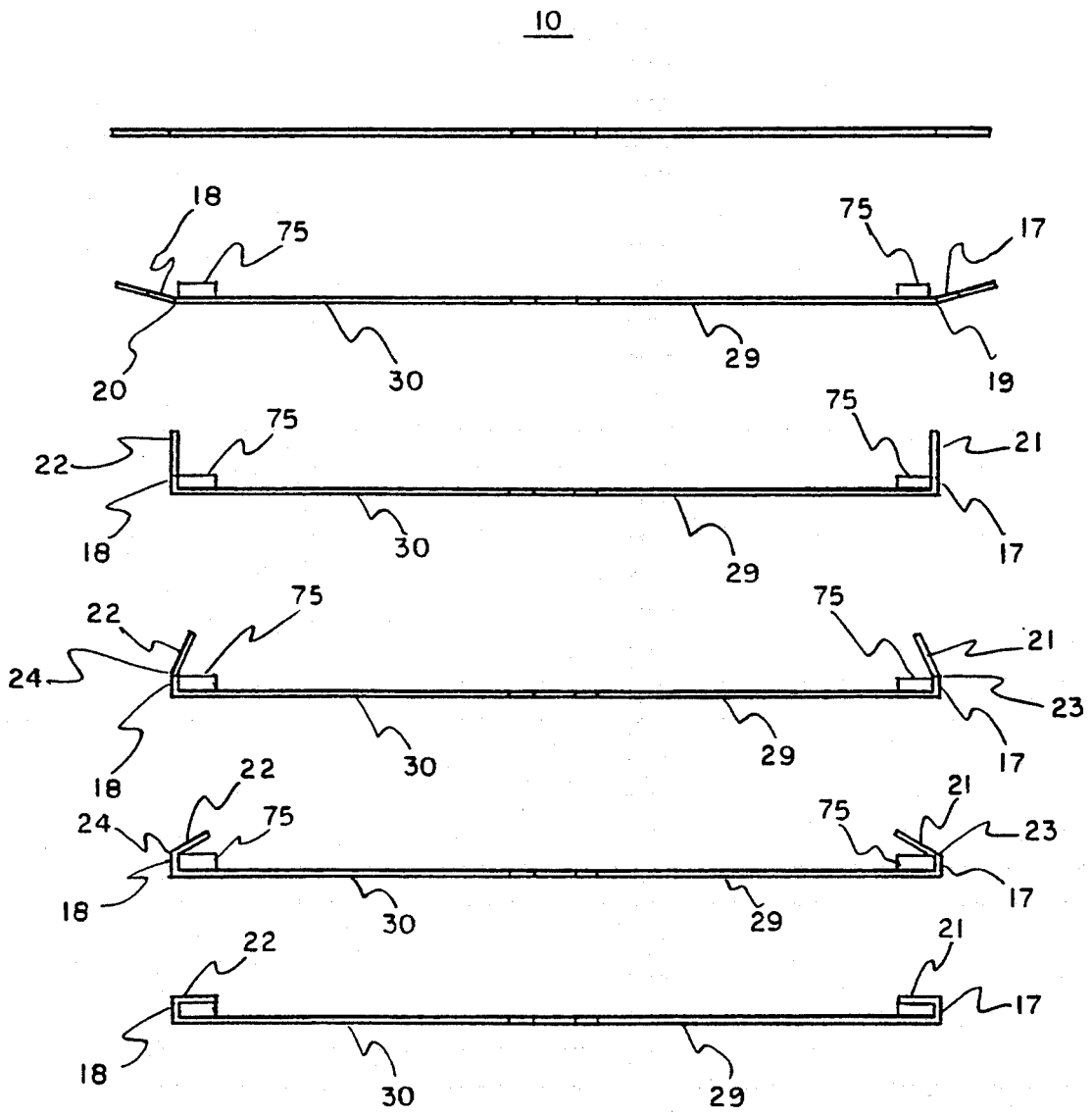
FIG. 4 is a diagrammatic sequential view illustrating the first set of folding operations as applied to a paper blank to be folded.

A pocket former apparatus 95 is provided, after the first stage folding section 65, which includes a reciprocable pusher plate 96 which folds the end flaps in conjunction with plate 88. The plate 96 is connected by a bracket 97 to a belt 98 carried on rollers 99 and is normally urged to the right as seen in FIG. 3 by a spring (not shown). The pusher plate 96 is located above the belt 70 and rests on top of blanks 10. One of the rollers 99 has a hub 100 with which a belt 101 is engaged to drive roller 99 to cause plate 96 to move to the left to fold the end flaps. The belt 101 is also engaged with a hub 102 from a wrap spring clutch 103, which has a belt 104 engaged therewith and with a roller 105 which in turn is driven by the belt 73. The pusher plate 96 can be driven in other ways as desired, such as by a crank arm (not shown).

A pair of rubber wheels 106 which rotate in one direction, may be provided mounted to bracket 107 and adjustable with respect to plate 88 to permit the end flaps 29 and 30 to pass therebetween and which put resistance thereon during withdrawal, to be described.

The completed boxed pocket folders 35 from pocket forming section 67 are deposited on a conveyor belt 110 in delivery section 68 which transports them to a storage area (not shown) for packaging and shipment to the users.

The conveyor belt 110 is carried on rollers 112 and 113, with a hub 114 on roller 112 engaged with belt 73. Belt 73 is also carried on rollers 115 and 116.

Roller 113 has a hub 120 thereon which is engaged by a belt 121 which is engaged with pulleys 122 and 123 and also engaged with drive pulley 124 from main drive motor 125.

A hold down truck assembly 126 is provided which includes wheels 127 carried on brackets 126 to engage finished folders 35 as they are transported on belt 110.

The mode of operation will now be pointed out. A blank 10 from the stack on feeder table 52 is picked off by air wheel 53 and deposited on rollers 59 which carry it to and between rollers 59 and 60, which deposit it on belt 70 of folding machine 50. Belt 70 carries the blank 10 to guide plates 76 and bars 75 where as shown in sequence in FIG. 4 the side panels 17 and 18 and glue tabs 21 and 22 are bent down around and on top of bars 75.

Figure 5:
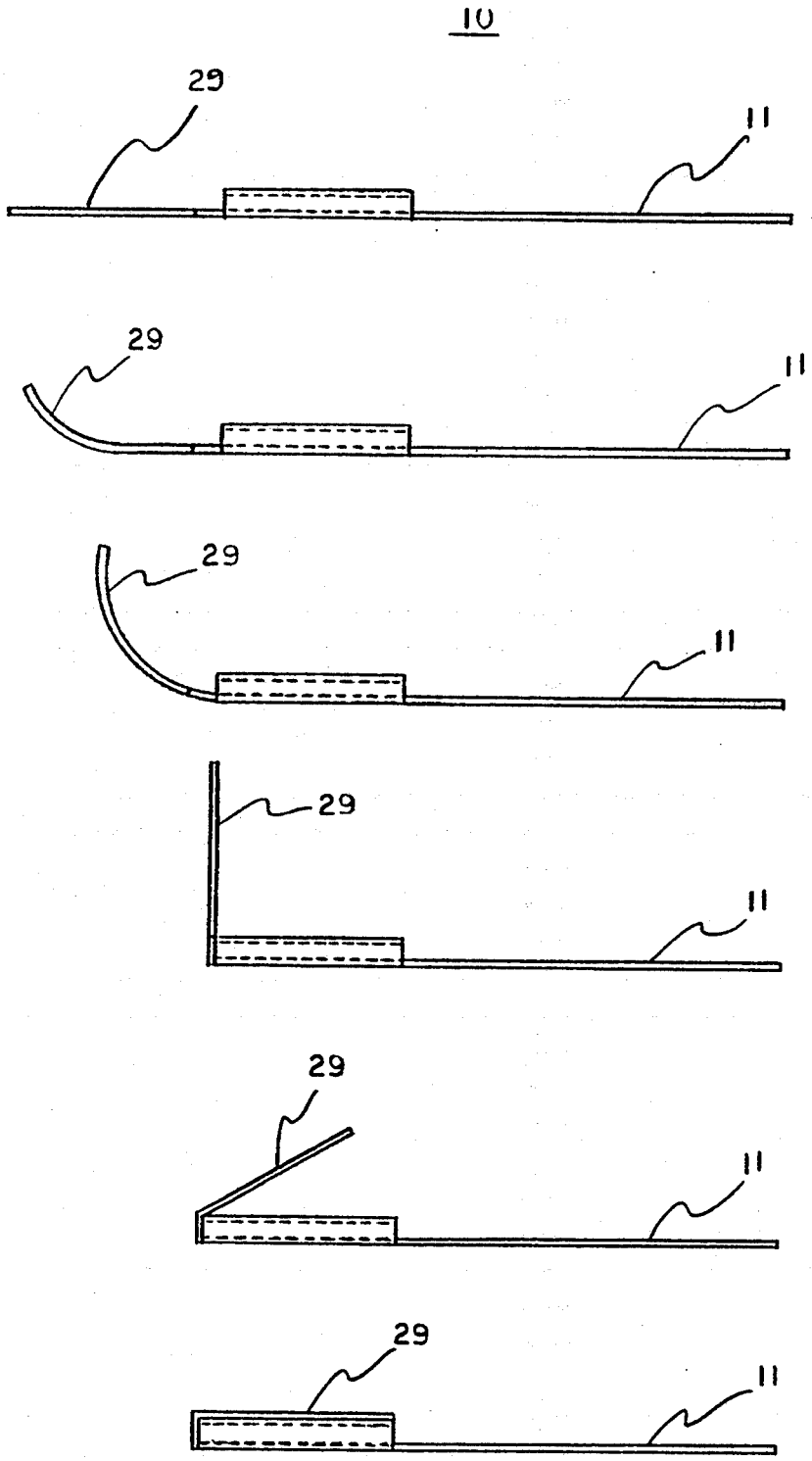
FIG. 5 is a view similar to FIG. 4 illustrating the second set of folding operations as applied to the blank of FIG. 4.

Belt 70 carries the blank 10 under the pusher plate 96 and past the glue heads 77 which deposit hot glue on top of tabs 21 and 22. The pusher plate 96 is activated to move to the left. The push-pull rod 84 moves to rotate tipper plate 80 so that end flaps 29 and 30 are forced upwardly between wheels 106 and plate 88 and against fold plate 88 to a vertical position as shown in FIG. 5 which sequentially from top to bottom illustrates the pocket forming operation.

Figure 6:
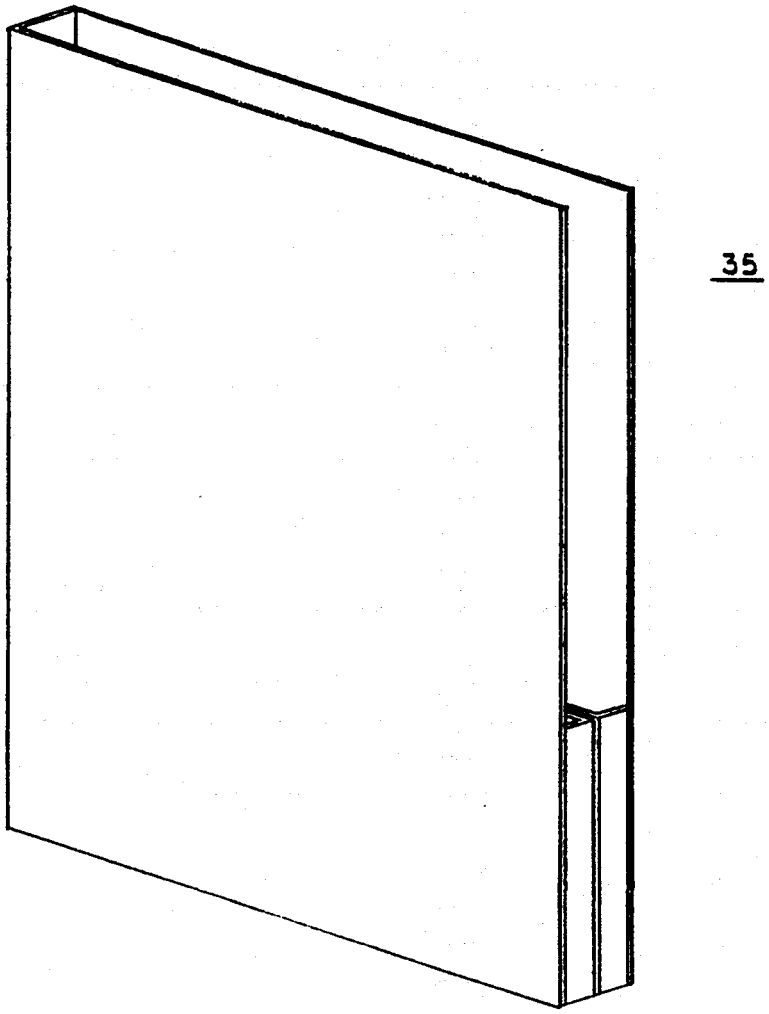
FIG. 6 is a view in perspective of a completed folder.

The plate 80 is rotated to the horizontal position and pusher plate 96 continues to move to the left under fold plate 88 with the pusher plate 96 engaged with the intermediate panels 25 and 26. As the blank 10 continues under the plate 88 end flaps 29 and 30 move down plate 88 and are folded down about score lines 31 and 32 by roller 89 until the glue on glue tabs 21 and 22 is contacted, which grips the end flaps 29 and 30 forming two boxed pockets on blank 10. The finished product 35 can be additionally folded about score lines 14 and 15 to provide the finished folder as shown in FIG. 6.

The pusher plate 96 then moves back to the right to engage another blank 10 and the operation continues.

It will thus be seen that apparatus has been provided with which the objects of the invention are achieved.

I claim:

1. A folding machine for forming a boxed pocket folder from a prescored paper blank, which blank has score lines which divide it into main panels, a center panel, side panels, glue tabs, intermediate panels, and end flaps, which machine comprises a first stage folding section, a gluing section, a second stage pocket forming section, a delivery section, said first stage folding section includes an endless belt to receive and transport blanks to be folded, at least one guide plate and bar to contact said side panels and said glue tabs to cause said side panels and said glue tabs to be folded along said score lines, said gluing section having glue dispensing means to dispense measured amounts of glue onto said glue tabs, said second stage pocket forming section includes pusher plate means, fold plate means to cooperate with said pusher plate means to form pockets on said blanks, tipper plate means to cause said end flaps to contact said fold plate for folding, and said delivery section having conveyor belt means to receive finished folders and transport them for packaging and shipping.

2. A folding machine as defined in claim 1 in which said tipper plate means includes a plate carried on a pair of arms that are rotated by push-pull rod means to selectively vary the angle of said plate from the horizontal to cause said end flaps to engage said fold plate means and then move tipper plate to the horizontal to allow the blank to pass under the fold plate.

3. A folding machine as defined in claim 1 in which said pusher plate means includes a pusher plate, a bracket connected to said pusher plate, a belt connected to said bracket, and drive means to drive said belt to reciprocate said plate and in conjunction with said fold plate folds said end flaps to form said pockets.

4. A folding machine as defined in claim 1 in which said fold plate means includes a vertically mounted adjustable fold plate, and a roller carried on the bottom of said fold plate.

5. A folding machine as defined in claim 4 in which said fold plate means includes at least one wheel adjacent said fold plate which engages and guides said end flaps of said blanks.

* * * * *